US009115414B2

(12) United States Patent
Korecki et al.

(10) Patent No.: US 9,115,414 B2
(45) Date of Patent: Aug. 25, 2015

(54) RETORT FURNACE FOR HEAT AND/OR THERMOCHEMICAL TREATMENT

(75) Inventors: Maciej Korecki, Świebodzin (PL); Robert Luźeńczyk, Świebodzin (PL); Józef Olejnik, Świebodzin (PL)

(73) Assignee: SECO/WARWICK S.A., Swiebodzin (PL)

( * ) Notice: Subject to any disclaimer, the term of this patent is extended or adjusted under 35 U.S.C. 154(b) by 111 days.

(21) Appl. No.: 12/702,912

(22) Filed: Feb. 9, 2010

(65) Prior Publication Data

US 2010/0272422 A1 Oct. 28, 2010

(30) Foreign Application Priority Data

Feb. 12, 2009 (PL) ..... 387256

(51) Int. Cl.

| | |
|---|---|
| ***C21D 9/00*** | (2006.01) |
| ***F27B 5/06*** | (2006.01) |
| ***F27D 1/18*** | (2006.01) |
| *C21D 1/773* | (2006.01) |

(52) U.S. Cl.

CPC ..... *C21D 9/0006* (2013.01); *F27B 5/06* (2013.01); *F27D 1/1858* (2013.01); *C21D 1/773* (2013.01)

(58) Field of Classification Search

CPC ..... H01L 21/67115; H01L 21/67109; H01L 21/67103

USPC ..... 219/400, 407, 411; 392/407, 416, 418, 392/432–437

See application file for complete search history.

(56) References Cited

U.S. PATENT DOCUMENTS

| | | | | | |
|---|---|---|---|---|---|
| 4,477,718 | A | * | 10/1984 | Crain et al. | 219/388 |
| 4,771,162 | A | * | 9/1988 | Schatz et al. | 219/400 |
| 4,883,002 | A | | 11/1989 | Schuster | |
| 6,008,477 | A | * | 12/1999 | Nakao et al. | 219/390 |

(Continued)

FOREIGN PATENT DOCUMENTS

| | | | |
|---|---|---|---|
| DE | 101 57 840 | C1 | 10/2002 |
| EP | 0 460 484 | A2 | 12/1991 |
| JP | 2007192514 | A * | 8/2007 |

OTHER PUBLICATIONS

Machine Translation of JP 2007-192514 A, Nov. 2011.*

(Continued)

*Primary Examiner* — Tu B Hoang
*Assistant Examiner* — Thomas Ward
(74) *Attorney, Agent, or Firm* — Oliff PLC

(57) ABSTRACT

A retort furnace for heat and/or thermochemical treatment designed for technological process in protective gas atmosphere, process gas atmosphere or in vacuum, and used inter alia for annealing pipes made of austenitic alloys, having among other things: a cylindrical outer body with a lid equipped with an active thermal barrier, a cylindrical retort, thermal insulation, a heating system located in the thermal insulation, a cooling system of the furnace. The active thermal barrier constitutes the radiation screens, in the form of at least two metal boards, installed on brackets located at the lid inside the retort. Additionally, radiation caulking rings are located in the extreme areas of the brackets and, circumferential sealing rings are permanently fixed in the casing of the retort.

6 Claims, 1 Drawing Sheet

(56) References Cited

U.S. PATENT DOCUMENTS 6,075,922 A * 6/2000 Tay et al. ..... 392/416
6,369,361 B2 * 4/2002 Saito et al. ..... 219/390
6,534,748 B1 * 3/2003 Zinman et al. ..... 219/390
6,737,613 B2 * 5/2004 Yamaguchi et al. ..... 219/390

OTHER PUBLICATIONS

European Search Report dated May 27, 2010 from European Patent Application No. 10 001 261.6.

* cited by examiner

RETORT FURNACE FOR HEAT AND/OR THERMOCHEMICAL TREATMENT

The subject matter of the invention is a retort furnace for heat and/or thermochemical treatment designed for technological processes in protective gas atmosphere, process gas atmosphere or in vacuum.

BACKGROUND

Known constructions of retort furnaces have a chamber separating the working space from the ambient environment and ensuring achieving the required purity and quality of the process atmosphere. The retort chamber is made of heat-resisting or creep-resisting alloys and allows working temperatures up to 1300° C. The retorts have outside heat insulation and heating elements in between. The elements provide heat energy that is accumulated using the insulation and is further directed to the retort through radiation and natural convection. Heat is transferred within the retort—from its walls to the charge—in result of radiation, natural convection or convection forced using atmosphere mixers.

Usually the furnaces are equipped with systems for accelerated cooling after the heat treatment. That is achieved using blowers forcing air between the insulation and the external wall of the retort. Cold air flowing around the retort takes over the heat and heats up, then escapes outside through an open top hatch. There are also internal cooling systems operating in a closed circuit. Then, the atmosphere is drawn directly from the inside of the retort, forced through a heat exchanger and, cooled, returned to the retort.

SUMMARY OF THE INVENTION

To allow opening of the furnace and putting the charge in the working space, the retort is equipped with a lid. The lid is sealed against the retort with a flange connection, where both the lid and the retort have flanges, and a rubber o-ring or a lip seal is the sealing element. The sealing flanges of the retort and the lid are water-cooled to ensure sufficiently low working temperature: about 80° C. The lid is closed and sealed with a mechanism that clamps both flanges with the seal in between. The lid also has thermal insulation preventing heat losses.

One of key process parameters of a furnace is evenness of temperature distribution in the working space. Depending on the heat treatment technology and quality requirements, the following temperature distribution evenness standards are applied, determining the class of the furnace (as specified in AMS 2750D): +/−28° C., +/−14° C., +/−10° C., +/−8° C., +/−6° C., and in the most advanced versions: +/−3° C.

The temperature distribution evenness in the working space depends on evenness and symmetry of the retort's heating system and on the size and evenness of heat losses. Factors negatively impacting the parameter include all heat bridges and losses in result of radiation or lack of heating elements. For that reason the size of the lid, located right next to the working space, is of crucial importance to the evenness of the temperature distribution inside the retort. There are heat bridges and the losses are increased by the water-cooled flanges, gas system ferrules and measurement sensors. In furnaces designed for vacuum operation, especially high vacuum, the ferrule of the pump system can take up a significant part of the lid surface and can cause very high heat losses that considerably upset the temperature distribution evenness, which makes it impossible to meet the +/−3° C. requirement, or even less stringent requirements.

The essential feature of the retort furnace consists in radiation screens in the form of at least two metal plates installed on brackets in the lid, inside the retort; moreover, the extreme areas of the brackets have radiation screens and radiation sealing rings as well as circumferential sealing rings permanently fixed in the retort casing.

It is preferable that the heating elements, preferably in the form of resistance wire, are located behind the radiation screens, on the inside of the retort.

It is also preferable that the heating elements are separated with a thermal screen.

Moreover, it is preferable that a temperature sensor is situated in the lid, in the range of the heating elements.

Use of the solution as invented ensures even temperature distribution at the whole length of the working space of the furnace in the range +/−2° C.

BRIEF DESCRIPTION OF THE DRAWINGS

The following under-named figures represent a schematic drawings of an exemplary blower according to the invention.

INDICATIONS IN THE DRAWINGS

1—the thermal barrier
2.—the lid
3—the retort
4—the brackets
5—the radiation screens
5*a*—the radiation sealing rings
6—the circumferential sealing rings
7—the heating system
8—the temperature evening screen
9—the thermocouple
10—the ferrule
11—the heating elements
12—the master
13—the air blowers
14—the top hatches
15—the lower duct
16—the water-cooled flange

DETAILED DESCRIPTION OF THE PREFERRED EMBODIMENTS

Figure 1:
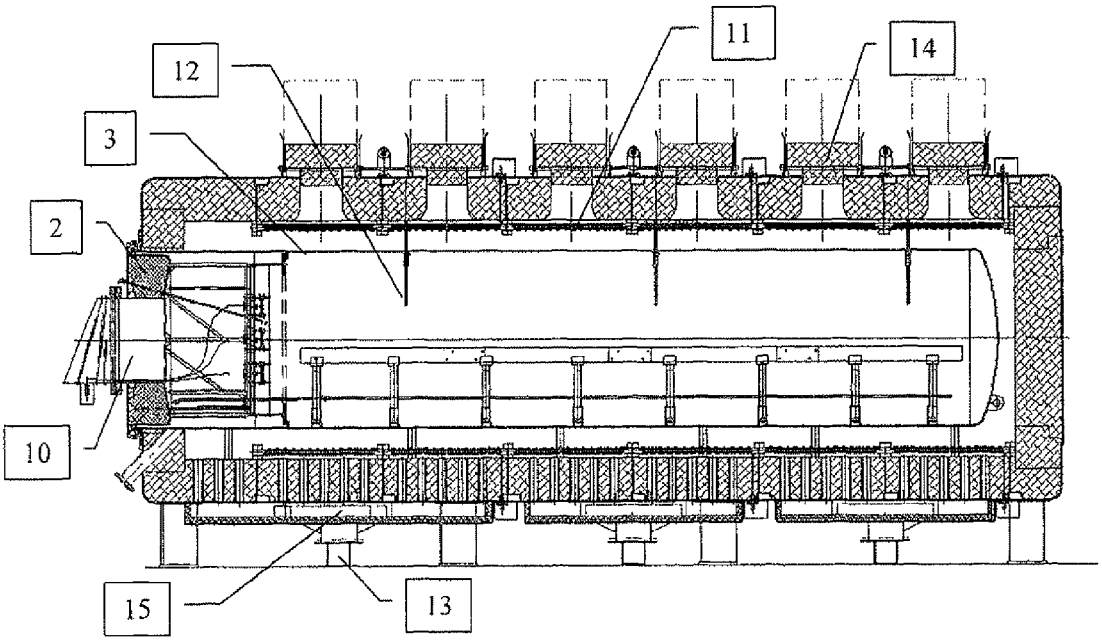
FIG. 1—presents a cross-section of the furnace in the vertical plane going through the longitudinal axis of the furnace, FIG. 2—presents a the furnace lid with an insulation system, hereinafter referred to as the thermal barrier, in the horizontal plane going through the longitudinal axis of the lid.
Figure 2:
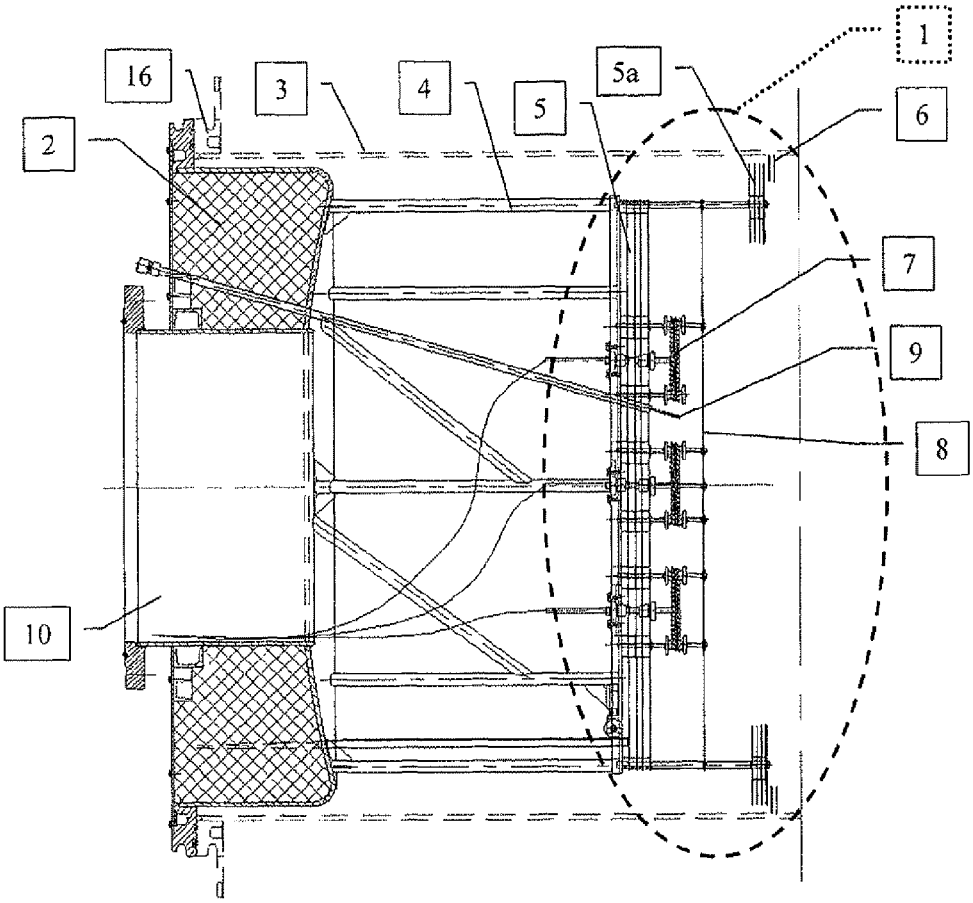

The invention will be further illustrated in an exemplary, not limiting application, for which FIG. 1 shows a cross-section of the furnace in the vertical plane going through the longitudinal axis of the furnace, and FIG. 2 shows the furnace lid with an insulation system, hereinafter referred to as the thermal barrier, in the horizontal plane going through the longitudinal axis of the lid.

The thermal barrier 1 (FIG. 2) is made up by brackets 4 located in the lid 2 inside the retort 3, used as support for radiation screens 5, in the form of metal screens with radiation sealing rings 5*a*, supporting circumferential sealing rings 6, permanently fixed at the inner surface of the retort 3. Additionally, there is a heating system 7 with a temperature evening screen 8 and thermocouple 9, ensuring temperature regulation of the thermal barrier 1 and its active operation. Keeping the temperature of the thermal barrier 1 the same as the temperature in the working space, the heat stream in the direction is eliminated and the temperature difference is reduced to minimum. At the same time the heat loss stream in the lid direction is completely compensated by the heating system 7.

The thermal barrier 1 is enclosed in the retort furnace (FIG. 1), which is designed for vacuum thermal processes, especially for annealing pipes made of austenitic alloys, on condition that the temperature distribution evenness in the working space is in the range +/−3° C., at the temperature not exceeding 650° C. The working space is 5.5 m long, 1.2 m wide and 0.16 m high (alternative width is 0.9 m and alternative height is 0.8 m).

The furnace is also equipped with a system of vacuum pumps based on a diffusion pump with 0.81 m inlet diameter, which requires installing a ferrule 10 with corresponding diameter in the lid 2.

The heating system is made up of heating elements n, evenly spaced outside the retort 3 and grouped in 3 longitudinal main zones, each of which consists of 3 subzones, circumferentially surrounding the retort 3 (9 subzones in total). The power of a subzone is 50 kW, while of a main zone −150 kW. The temperature is regulated in a cascade system (master-slave) and is based on 3 temperature sensors (K-type thermocouples), master 12, located inside the retort 3, right above the working space and 9 temperature sensors (K-type thermocouple), slave, located in 9 subzones, by the heating elements.

The cooling system consists of 3 air blowers 13 and 6 top hatches 14, two for each of the blowers. Blowers 13 force ambient air to the lower duct 15 and, further, between the insulation and the outer wall of the retort 3. The air, flowing around the retort 3, takes over the heat and escapes through upper hatches 14.

The active thermal barrier 1 is installed in the lid 2 of the retort 3; it consists of 5 metal screens 5 and 4 radiations sealing rings 5*a*. Additionally, it features two stationary screens in the form of circumferential sealing rings 6 situated in the internal wall of the retort 3 in order to close the clearance (when the lid 2 is closed) between the moving screens of the retort 5 and 5*a* and the retort wall 3.

The electric heating element 7 is made of resistance wire of 18 kW power. For evening of the temperature, the single metal screen 8 is installed on the working space side of the retort 3. The temperature in the thermal barrier heating element space 1 is regulated using the K-type thermocouple 9 and is set dynamically depending on the current measured temperature value in the retort 1 in the front barrier zone adjacent to the retort 1. In result of eliminating the temperature difference between the thermal barrier 1 and the working space of the retort 3, there is no heat loss stream toward the lid 2 deteriorating the temperature distribution evenness in the working space.

The system has been tested by heating the furnace and maintaining 600° C. and taking temperature distribution measurements in 11 extreme points of the working space. After stabilization of the temperature, power losses in specific zones were as follows: back zone—10.9 kW, middle zone—10.4 kW, front zone—19.5 kW and the heating elements 7 of the thermal barrier 1—4.2 kW. The higher load of the front zone results from the level of losses through the retort wall connected with the water-cooled flange 16. The power of the thermal barrier's heating system offsets the losses through the lid 2. The temperature adjustment system with the active thermal barrier 1 was stable and completely under control. The achieved temperature distribution evenness in the working space was very good: +/−2° C.

The invention claimed is:

1. A retort furnace for heat or thermochemical treatment designed for technological process in a protective gas atmosphere, a process gas atmosphere or in a vacuum, and used at least for annealing pipes made of austenitic alloys, the retort furnace comprising:

a cylindrical outer body having a lid equipped with an active thermal barrier;

a cylindrical retort made of at least one of: i) steel, ii) heat-resisting alloys, and iii) creep-resisting alloys, the cylindrical retort separating a processing atmosphere from an ambient atmosphere;

a thermal insulation disposed outside of the cylindrical retort;

a heating system located in the thermal insulation;

a cooling system including a plurality of air blowers and two top hatches for each of the plurality of air blowers, the top hatches and the plurality of air blowers being disposed on opposite ends of the cylindrical retort; and a barrier temperature sensor extending through the lid, wherein the lid has a separate cooling system, the active thermal barrier comprises: i) a plurality of brackets extending from the lid into the cylindrical retort, (ii) a temperature evening screen connected to at least one bracket and positioned remote from the lid, (iii) a plurality of radiation screens, in the form of at least two metal boards, installed on at least one bracket and located between the lid and the temperature evening screen, the radiation screens having barrier heating elements in the form of resistance wire, which are located behind the radiation screens, on the inside of the cylindrical retort, iv) radiation sealing rings located at an end of at least one bracket opposite from the lid and extending beyond the temperature evening screen, a thermocouple of the barrier temperature sensor is located in a range of the barrier heating elements, an additional thermal screen is located behind the barrier heating elements, and the cylindrical retort comprises circumferential sealing rings permanently fixed in a casing of the cylindrical retort and located adjacent to the radiation sealing rings when the lid is closed in the cylindrical retort.

2. The retort furnace according to claim 1, wherein the cylindrical outer body is disposed in a horizontal position.

3. The retort furnace according to claim 1, wherein the cylindrical outer body is disposed in a vertical position.

4. A retort furnace for heat or thermochemical treatment designed for technological process in a protective gas atmosphere, a process gas atmosphere or in a vacuum, and used for annealing pipes made of austenitic alloys, retort furnace comprising:

a cylindrical outer body with a lid equipped with an active thermal barrier;

a cylindrical retort made of steel or heat-resisting or creep-resisting alloys, separating a processing atmosphere from an ambient atmosphere;

a thermal insulation disposed outside of the cylindrical retort;

a heating system located in the thermal insulation;

a cooling system configured to cool the furnace;

a cooling system configured to cool the lid; and a barrier temperature sensor extending through the lid, wherein the active thermal barrier comprises: i) a plurality of brackets extending from the lid into the cylindrical retort, (ii) a temperature evening screen connected to at least one bracket and positioned remote from the lid, (iii) a plurality of radiation screens, in the form of at least two metal boards, installed on at least one bracket and located between the lid and the temperature evening screen, the radiation screens having barrier heating elements in the form of resistance wire, which are located behind the radiation screens, on the inside of the cylindrical retort, (iv) a plurality of heating elements located between the plurality of radiation screens and the temperature evening screen, v) radiation sealing rings located at an end of at least one bracket opposite from the lid and extending beyond the temperature evening screen, a thermocouple of the barrier temperature sensor is located in a range of the barrier heating elements, an additional thermal screen is located behind the barrier heating elements, and the cylindrical retort comprises circumferential sealing rings permanently fixed in a casing of the cylindrical retort and located adjacent to the radiation sealing rings when the lid is closed in the cylindrical retort.

5. The retort furnace according to claim 4, wherein the cylindrical outer body is disposed in a horizontal position.

6. The retort furnace according to claim 4, wherein the cylindrical outer body is disposed in a vertical position.

* * * * *